United States Patent [19]

Benoist et al.

[11] 4,189,282

[45] Feb. 19, 1980

[54] DEVICE TO SECURE VANES TO A ROTOR

[75] Inventors: Josette Benoist, Le Mee sur Seine; Pierre A. Glowacki, Melun; Gérard M. F. Mandet, Epinay sous Senart, all of France

[73] Assignee: Societe Nationale d'Etude et de Construction de Moteurs d'Aviation, Paris, France

[21] Appl. No.: 912,862

[22] Filed: Jun. 5, 1978

[30] Foreign Application Priority Data

Jun. 8, 1977 [FR] France ..... 77 18254

[51] Int. Cl.[2] ..... F01D 5/32

[52] U.S. Cl. ..... 416/221; 416/193 A

[58] Field of Search ..... 416/219, 220, 221, 193 A

[56] References Cited

U.S. PATENT DOCUMENTS

| | | | |
|---|---|---|---|
| 3,096,074 | 7/1963 | Pratt et al. | 416/221 |
| 3,295,825 | 1/1967 | Hall | 416/221 |
| 4,019,833 | 4/1977 | Gale | 416/220 |

FOREIGN PATENT DOCUMENTS

| | | | |
|---|---|---|---|
| 2324873 | 4/1977 | France | 416/220 |

*Primary Examiner*—Everette A. Powell, Jr.
*Assistant Examiner*—A. N. Trausch, III
*Attorney, Agent, or Firm*—Bacon & Thomas

[57] ABSTRACT

A device to secure and insure the tightness of vanes of a turbine is an annular plate which carries on the side toward its external edge a plurality of studs and toward its internal edge a plurality of hangers. The disk of the rotor has on its lower edge a series of teeth or indentations, the top of the teeth having a configuration to cooperate with the inner surface of the hangers. The vanes have on their rims a plurality of grooves. Two adjacent vanes form a groove into which the studs enter when the hangers cooperate with the teeth. The studs are borne by tongues cut radially into the annular plate.

5 Claims, 3 Drawing Figures

DEVICE TO SECURE VANES TO A ROTOR

BACKGROUND OF THE INVENTION

The invention concerns a device to secure the vanes of a turbine on a rotor, with the disk of the rotor carrying at its periphery a plurality of axial grooves into which the roots of the vanes slide.

Numerous devices have been developed to retain vanes and more particularly the roots of vanes, in grooves provided on the rim of a rotor. These devices generally consist of plates which lodge in channels provided in the radial surface of the disk and may be slid in front of the roots of the vanes and secured in place by mechanical deformation.

The devices described above secure the vanes in place satisfactorily, but do not prevent air leaks. In actual fact, each vane is traversed by channels receiving cooling air through the roots. There is an obvious interest in limiting losses to a minimum. It is also of interest to reduce the number of pieces to be handled in assembling the engine. French Pat. No. 1,307,564 partially solved these problems and describes a device comprising an annular plate and keys. The radial surface of the disk has a plurality of channels, with the uppermost channel continuing and extending into the rim of the vanes and the lower channel defining a series of teeth, spaced apart. A number of keys, carrying a small tongue, and retained by it, the annular plate is fastened under the upper channel and comes to rest on the keys so that the notches provided in said plate are placed in front of the tongues of the keys. The tongues are then projected into the notches by deformation, thus locking the annular plate in place against the radial surface of the disk.

SUMMARY OF THE INVENTION

The present invention proceeds from the preceding device and has as its object the elimination of the usual keys or bolts. The device is designed to secure the vanes of a turbine rotor, according to the invention, with the disk of the rotor having a rim on the periphery of which a plurality of axial grooves is arranged, the roots of the vanes being slid into said grooves. At least one annular, axial retaining check plate is coaxial with the disk and fastening and blocking means to maintain the check plate in position on the rim and the invention is characterized by the fact that said fastening means consist of conical projections cooperating, respectively, with the lower edge of the rim and hangers mounted perpendicularly to the plane of the check plate on the lower edge of the check plate, said lower edge of the rim comprising indentations to receive the hangers of the check plate prior to its location by rotation, and said blocking means consist of studs located at the ends of elastic tongues cut radially from the check plate and cooperating with grooves of a corresponding shape, provided in the feet of the vanes.

BRIEF DESCRIPTION OF THE DRAWINGS

The explanation and figures, presented hereafter as examples, will provide an understanding of how the invention may be embodied.

DESCRIPTION OF THE PREFERRED EMBODIMENT

Figure 1:
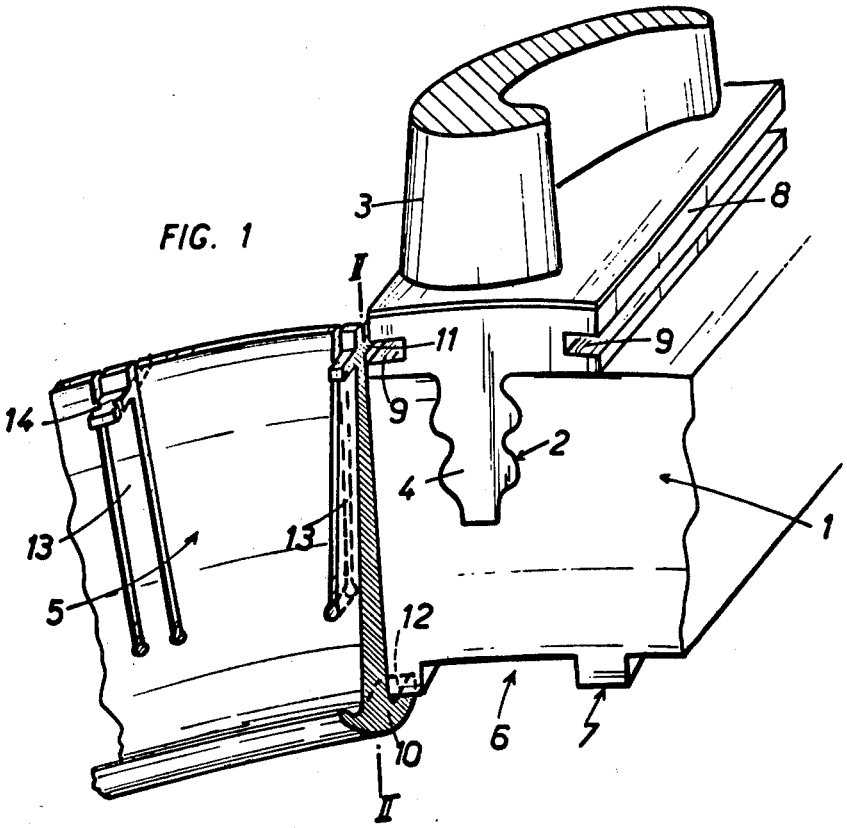
FIG. 1 is a partially sectional view of a turbine disk equipment with a securing device according to the invention.

FIG. 1 shows a part 1 of the rotor disk having at its periphery the axial grooves 2 in the form of fir tree slots, into which slide the vanes 3 of the turbine. According to one embodiment in general use, not shown, the vanes include in their thickness cooling channels, in which air coming from the center of the rotor, circulates. These channels traverse the roots 4 and correspond with passages provided in the disk. It is thus necessary to insure as nearly perfectly tight a seal as possible between the fir tree slot and the root of the vane and to prevent losses through the lateral edges. It is no less necessary to secure the vanes in their grooves and to prevent any slipping along the axis of the disk. To accomplish this, an annular check plate 5 is placed on the sides of the disk and in front of the roots of the vanes. According to the invention, the configuration of the annular check plate is such that said plate is capable of cooperating with the elements of a securing device pertaining to both the disk and the vanes.

Figure 2:
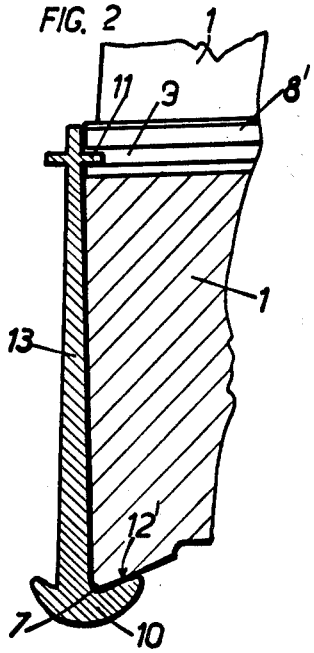
FIG. 2 is a sectional view according to II—II of FIG. 1.

The annular check plate 5 is formed at its inner edge with the hangers 10 protruding essentially perpendicularly to the plane of the check plate and toward the disk. Each hanger 10 has a flange turned toward the outside and inclined away from the axis in the direction opposed to the disk. The different faces 12 of the hangers and flange define cone surfaces coaxial with the rotor. Further, as may be seen better in the sectional view of FIG. 2, the inner edge of the rim 1 of the disk defines teeth 7 each of which is cut at a bevel, the face 12' of which slopes toward the inside of the rotor and is inclined to form a conical surface complementary of the faces 12 of the hangers.

According to an important characteristic of the invention, the elastic tongues 13 are formed by cutting radially into the thickness of the annular check plate 5 so as to leave a free end at the side of the outer peripheral edge of the check plate. This tongue 13 carries a projection 11 protruding in the direction of the rim of the disk. Grooves 9 of a corresponding shape are arranged for each of the projections in the feet of the vanes. The expression "the feet of the vanes" signifies the assembly located under the base of the blade of the vane, said assembly generally consisting, in the mode of securing the vanes by means of profiled roots slid into the grooves of the rim, of a vane root 4 surmounted by a platform 8. In the example shown, the grooves 9 are defined by a portion of a slot cut into the axial edges 8' of each platform 8.

The tongues 13, equipped with the projections 11, are provided so that the projections will be located in front of the grooves 9, when a hanger 10 is engaged with the surface 12 of a tooth 7.

According to the example shown, there are as many hangers as there are teeth 7 and one hanger and one tooth are located essentially on a radius of the disk and at the same side of the plate. The projection 11 penetrates into the groove 9, which consists of two parts: one half of the groove consists of the end of a slot provided in the ledge of the vane, parallel to the axis of the disk, the other half is formed by a corresponding and facing slot of an adjacent vane. One projection is thus hooked into two adjacent vanes. Because of the disposition of the projections and the hangers on the annular check plate, the disk may be designed so that the longitudinal plane of symmetry of the fir tree slot is centrally between two teeth 7, upon which the hangers 10 will be placed. In other words, one tooth should be located between two fir tree slots receiving the roots of two adjacent vanes. The part of the check plate between two tongues 13 corresponds to the transverse width of the vane and assures its maintenance in place and its tightness.

A gripping means is provided on the rear face of the tongue 13 carrying the projection 11, in order to make possible the extraction of said projection from its groove 9.

The installation of the securing device takes place as follows: after placing the securing device in the rear (not shown), the vanes are slid into their grooves, the annular plate 5 is then placed against the side of the disk so that the hangers 10 are located in the spaces between the teeth 7. While urging the check plate against the side of the rotor disk 1, it is turned through an angle corresponding to the angle separating a space from a tooth. The hanger 10 and more particularly the face 12 will be located behind the end of a tooth, against which it is blocked in the axial direction. The projections, which up to this time had been flexed outwardly with respect to the face of the check plate in contact with the side of the disk, now flex into the grooves 9, because of the elasticity of the tongue 13, insuring that the annular check plate is locked in place with respect to rotation.

The annular check plate may be removed by using a tool cooperating with the gripping means 14 and effecting the retraction of the projections 11 from their grooves and by then rotating the plate to guide the hangers 10 into the spaces provided between the teeth 7.

Figure 3:
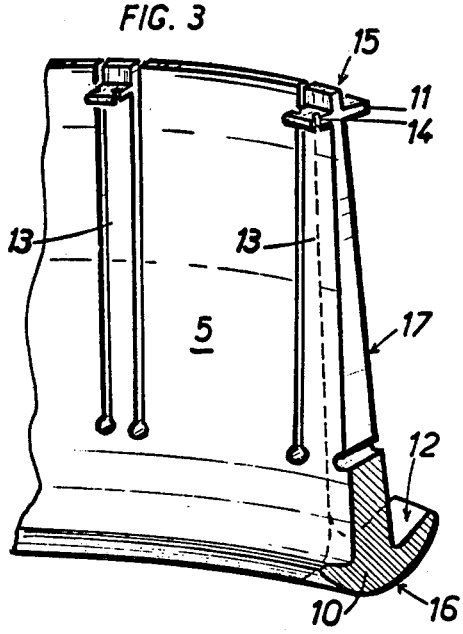
FIG. 3 is a perspective, partially in section, of a part of the annular plate along a radial cut forming a tongue.

According to one embodiment of the annular check plate as shown in FIG. 3, said check plate is machined so as to present an increasing width from its outer edge 15 toward its inner edge 16. On the face 17 and toward the edge 15, an initial ridge is left, which after machining, leaves the projections 11. On the edge 16 a second ridge is likewise left, which can be machined to leave the hangers 10. These ridges are eliminated at least partially on the parts of the check plate corresponding to the free faces of the roots of the vanes. The tongues are then formed by cutting essentially in a radial direction into the check plate. The trapezoidal cross section of the plate serves the purpose of obtaining tongues with an elasticity adequate to maintain the projections in their grooves and hangers sufficiently massive to prevent their deformation under the effect of the centrifugal force.

As an example of the order of magnitude, the thickness of the check plate at the inner edge may be approximately twice the thickness of said check plate at its outer edge. If these thicknesses are, for example, 2 mm and 1 mm, respectively, a width of the tongue of 4 mm may be specified.

The economy in material provided by the device of the present invention will be noted. The elevated rotational velocities of the rotor, also taking into consideration the diameter of the rims of the disk, are the cause of high mechanical stresses; a lightening of the rotating pieces contributes to their reduction.

It will also be noted that the tongues which are part of the securing device according to the invention, participate simultaneously, because they are an integral part of the check plate, in the mechanical securing of said plate, which is important in assuring good functional tightness at the check plate. The invention provides means to secure the device to the side of the disk without requiring the use of classic means, such as bolts or locks with deformable tongues and to assure the proper relation of the roots of the vanes to their environment.

It should be understood that the invention is in no way limited to the embodiments described in the foregoing as examples. Thus, specifically, the number of hangers may be independent of the number of tongues and the number of vanes. Similarly, the grooves for the projections 11 need not overlap two consecutive vanes nor are they necessarily located at the level of the roots of the vanes.

We claim:

1. In a device for securing vanes to a turbine rotor wherein said rotor is a disk having a rim with a plurality of axial grooves on its outer periphery, vanes having roots extending slidably into said grooves and said device comprising at least one annular retaining check plate coaxial with said disk, abutting the ends of said roots, and means for securing said check plate in position, the improvement comprising:

said securing means being in the form of radially inwardly extending projections on the radially inner edge of the rim, and generally hook-shaped hangers formed on the radially inner edge of the check plate and engaging said projections to prevent axial movement of said check plate away from said disk, said projections being spaced apart to define indentations for receiving said hangers, said hangers being engageable with and disengageable from said projections by rotating said check plate relative to said disk;

elastic tongues defined by cuts extending radially inwardly from the radially outer edge of said check plate;

axially extending studs at the outer ends of said tongues, extending toward said disk; and recesses in the adjacent ends of said vanes, said studs extending into said recesses to prevent rotation of said check plate relative to said disk.

2. A device according to claim 1 wherein each vane includes a platform portion, adjacent said disk, abutting the platform portion of an adjacent vane, each of said recesses being formed partially in each of adjacent platforms whereby said studs each engages two adjacent vanes.

3. A device according to claim 1 wherein said studs are in radial alignment with said hangers.

4. A device according to claim 1 including gripping means adjacent the outer ends of said tongues, on the side of said check plate opposite said studs whereby said studs may be selectively withdrawn from said recesses.

5. A device according to any one of the preceding claims wherein said annular check plate has an essentially trapezoidal cross section, its radially outer edge being thinner than its radially inner edge.

* * * * *